US009281138B2

(12) United States Patent
Dolinski et al.

(10) Patent No.: US 9,281,138 B2
(45) Date of Patent: Mar. 8, 2016

(54) PARALLEL TYPE TRANSFER SWITCH CONTACTS ASSEMBLIES

(71) Applicant: ASCO Power Technologies, L.P., Florham Park, NJ (US)

(72) Inventors: Walter Dolinski, Sayreville, NJ (US); Wei Li Chuang, Livingston, NJ (US)

(73) Assignee: ASCO Power Technologies, L.P., Florham Park, NJ (US)

( * ) Notice: Subject to any disclaimer, the term of this patent is extended or adjusted under 35 U.S.C. 154(b) by 0 days.

(21) Appl. No.: 14/171,572

(22) Filed: Feb. 3, 2014

(65) Prior Publication Data

US 2014/0218140 A1 Aug. 7, 2014

Related U.S. Application Data

(60) Provisional application No. 61/760,756, filed on Feb. 5, 2013.

(51) Int. Cl.

| | |
|---|---|
| ***H01H 3/00*** | (2006.01) |
| ***H01H 9/00*** | (2006.01) |
| ***H01H 51/00*** | (2006.01) |
| ***H01H 67/06*** | (2006.01) |
| ***H01H 1/42*** | (2006.01) |
| *H01H 1/44* | (2006.01) |
| *H01H 1/50* | (2006.01) |
| *H01H 1/54* | (2006.01) |

(52) U.S. Cl.

CPC . *H01H 1/42* (2013.01); *H01H 1/44* (2013.01); *H01H 1/50* (2013.01); *H01H 1/54* (2013.01); *H01H 2300/018* (2013.01)

(58) Field of Classification Search

CPC ..... H01H 50/54

USPC ..... 335/72, 114, 125

See application file for complete search history.

(56) References Cited

U.S. PATENT DOCUMENTS

| | | | | | |
|---|---|---|---|---|---|
| 2,233,336 | A | * | 2/1941 | Bentley | 200/274 |
| 2,931,876 | A | * | 4/1960 | Weinfurt | 200/254 |
| 3,632,935 | A | * | 1/1972 | Stegmaier | 200/571 |
| 4,063,204 | A | * | 12/1977 | McFarlin | 335/193 |
| 4,090,046 | A | * | 5/1978 | Faust et al. | 200/43.08 |
| 4,251,700 | A | * | 2/1981 | Zaffrann et al. | 218/12 |
| 4,321,436 | A | * | 3/1982 | McGarrity | 200/48 KB |
| 4,395,606 | A | * | 7/1983 | Zaffrann et al. | 218/149 |
| 4,584,621 | A | * | 4/1986 | Yang | 361/3 |
| 4,745,244 | A | * | 5/1988 | Spinner | 200/258 |
| 4,875,278 | A | * | 10/1989 | McIntosh | 29/622 |

(Continued)

*Primary Examiner* — Alexander Talpalatski

(74) *Attorney, Agent, or Firm* — McDonnell Boehnen Hulbert & Berghoff LLP

(57) ABSTRACT

A movable contact assembly for use with a transfer switch, the moveable contact assembly comprising a center portion, a first conductor portion extending from the center portion, the first conductor portion comprising a first arm comprising two longitudinal extending fingers; and a second conductor portion extending from the center portion, the second conductor portion comprising a second arm comprising two longitudinally extending fingers. The moveable contact assembly may be pivoted about the center portion from a first position to a second position. In the first position, the two longitudinally extending fingers of the first conductor portion resides in a conductive state with a blade connector of a first stationary contact assembly and in the second position, the two longitudinally extending fingers of the second conductor portion resides in a conductive state with a blade connector of a second stationary contact assembly.

18 Claims, 6 Drawing Sheets

(56) References Cited

U.S. PATENT DOCUMENTS 4,944,083 A * 7/1990 McIntosh ..... 29/622
5,945,650 A * 8/1999 Holland et al. ..... 218/1
6,222,139 B1 * 4/2001 Pandit et al. ..... 200/11 A
6,265,685 B1 * 7/2001 Faure et al. ..... 218/149
6,765,157 B2 * 7/2004 Rademacher et al. ..... 200/1 R
8,040,664 B2 * 10/2011 Makinson et al. ..... 361/661
2002/0057145 A1 * 5/2002 Kern et al. ..... 335/6

* cited by examiner

PARALLEL TYPE TRANSFER SWITCH CONTACTS ASSEMBLIES

BACKGROUND

1. Field of the Patent Application

The present disclosure is generally directed to contact assemblies for use with an electric power switching apparatus. More specifically, the present disclosure is generally directed to a moving contact assembly and a stationary contact assembly for use with an electric power switching apparatus. Such moving and stationary contact assemblies allow the switching apparatus to achieve a high withstand and close-on current ratings. For example, such withstand and close-on current ratings may achieve withstand and close-on current ratings of more than 10,000 A. In one arrangement, the present disclosure relates generally to a contact assembly arrangement that may be used for electrical power transfer and, more particularly, may be used in an automatic transfer switch. However, aspects of the invention may be equally applicable in other scenarios as well.

2. Description of Related Art

An automatic transfer switch is designed to provide a continuous source of power for critical loads by automatically transferring from a normal power source to an emergency power source when the normal power source falls below a preset limit. Automatic transfer switches are in widespread use in airports, subways, schools, hospitals, military installations, industrial sites, and commercial buildings equipped with secondary power sources and where even brief power interruptions can be costly or perhaps even life threatening.

Transfer switches operate, for example, to transfer a power consuming load from a circuit with a normal power supply to a circuit with an auxiliary power supply. A transfer switch can control electrical connection of utility power lines and the diesel generator to facility load buses. In certain installations, the transfer switch automatically starts a standby generator and connects the standby generator to the load bus upon loss of utility power. In addition, the transfer switch can automatically reconnect the utility power to the load bus if utility power is reestablished.

Automatic transfer switches are typically multi-pole switches. Therefore, an automatic transfer switch used with a three phase, four wire system will typically include three poles for switching the three phase conductors of the load between the three phase conductors of the normal power source and the three phase conductors of the emergency power source. The fourth, neutral conductor of the load is often permanently connected to the neutral conductors of the normal and emergency sources.

Unlike circuit breakers, which are designed to promptly open contacts (see for example, U.S. Pat. No. 6,977,568 which is herein entirely incorporated by reference and to which the reader is directed for further information), transfer switches are designed to remain in a closed state during certain fault conditions. For example, certain known circuit breakers employ the electromagnetic forces to blow contacts open and limit the amount of fault current that a system downstream may see. Certain transfer switches utilize contacts similar to circuit breaker design and overcome the blow off contact forces by employing mechanical operators with toggles.

Therefore, when used in a distribution system with circuit breakers, the transfer switch must have sufficient short circuit fault capability and protection so as to withstand and/or close-on short circuit and stay closed long enough to allow circuit breakers to open under the appropriate circumstances.

Accordingly, it would be desirable to provide a cost-effective automatic transfer switch that is easy to assemble and install. There is also a general need for an automatic transfer switch that can provide a sufficient short circuit fault protection while also allowing the contact assembly configuration to stay closed long enough to allow a system circuit breaker to open under the appropriate circumstances. There is also a general need for an enhanced automatic transfer switch designed to withstand and/or close on very high short circuit fault currents by employing electromagnetic forces to keep contacts closed.

SUMMARY

According to an exemplary embodiment, a movable contact assembly for use with a switching mechanism comprising, a center portion, a first conductor portion extending from said center portion, the first conductor portion comprising a first arm comprising two longitudinal extending finger conductors. A second conductor portion extends from the center portion, the second conductor portion comprising a second arm comprising two longitudinally extending finger conductors. The moveable contact assembly may be pivoted about the center portion from a first position to a second position wherein in the first position, the two longitudinally extending finger conductors of the first conductor portion resides in a conductive state with a blade connector of a first stationary contact assembly of the switching mechanism. In the second position, the two longitudinally extending finger conductors of the second conductor portion resides in a conductive state with a blade connector of a second stationary contact assembly of the switching mechanism.

A movable contact assembly for use with a switching device, the moveable contact assembly comprising a center portion, a first conductor portion extending from said center portion, said first conductor portion comprising a first arm comprising a first blade connector; and a second conductor portion extending from said center portion, said second conductor portion comprising a second arm comprising a second blade connector. Said moveable contact assembly may be pivoted about said center portion from a first position to a second position wherein in said first position, said first connector blade of said first conductor portion resides in a conductive state with two longitudinally extending finger conductors of a first stationary contact assembly; and in said second position, said second connector blade of said second conductor portion resides in a conductive state with two longitudinally extending finger conductors of a second stationary contact assembly.

BRIEF DESCRIPTION OF THE DRAWINGS

Exemplary embodiments are described herein with reference to the drawings, in which.

DETAILED DESCRIPTION

Figure 1:
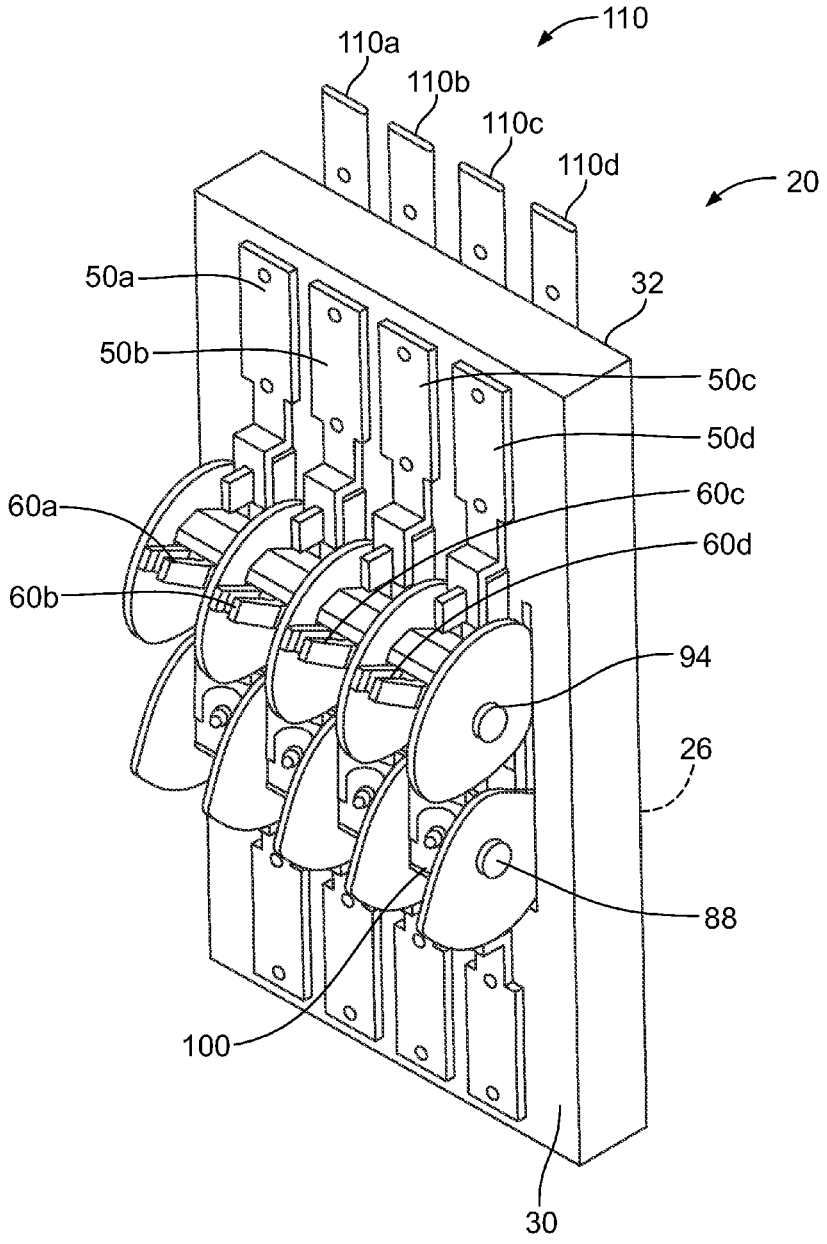
FIG. 1 illustrates a perspective view of a transfer switch panel assembly according to one aspect of the present disclosure.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented herein. It will be readily understood that the aspects of the present disclosure, as generally described herein, and illustrated in the figures, can be arranged, substituted, combined, separated, and designed in a wide variety of different configurations, all of which are explicitly contemplated herein.

Figure 2:
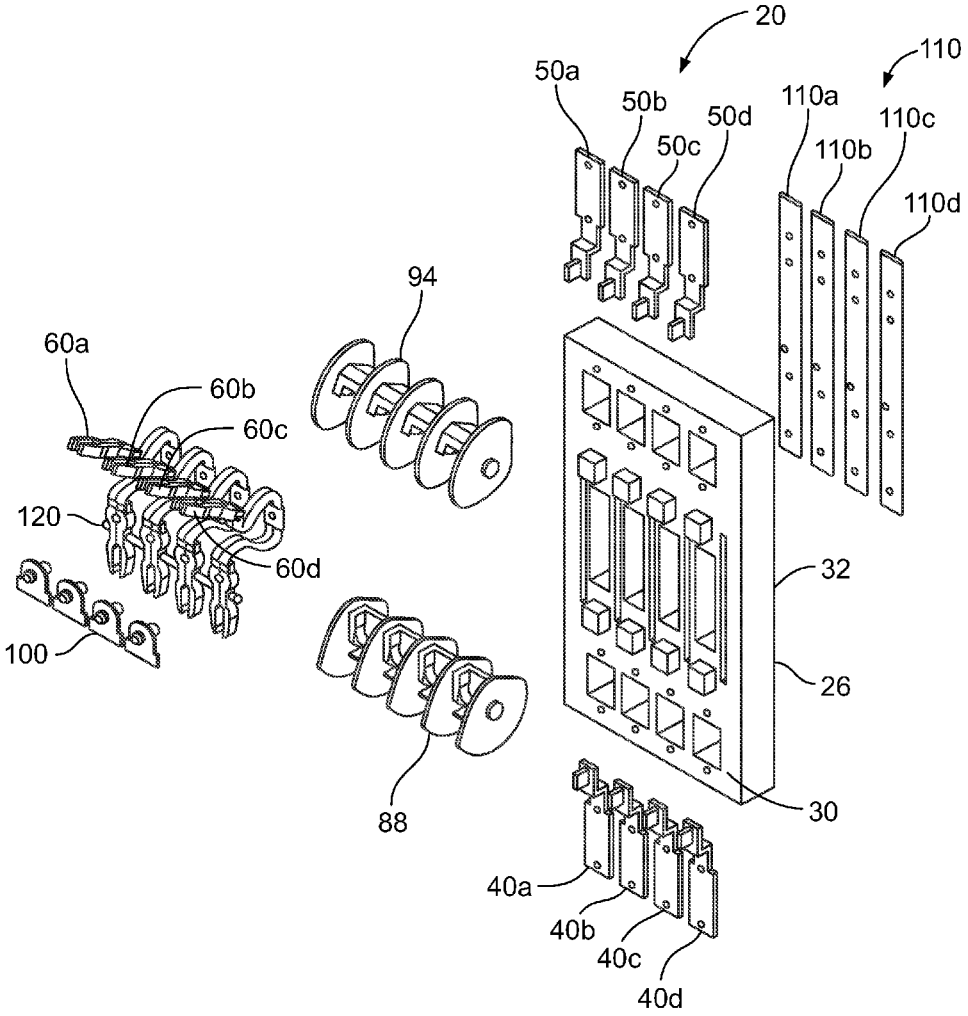
FIG. 2 illustrates an exploded view of the various component parts making up the transfer switch panel assembly illustrated in FIG. 1.

FIG. 1 illustrates a perspective view of a transfer switch panel assembly 20 according to one aspect of the present application. FIG. 2 illustrates an exploded view of the various component parts making up the transfer switch panel assembly 20 illustrated in FIG. 1. As illustrated, the transfer switch panel assembly 20 comprises a four-pole automatic transfer switch.

The present disclosure will be described in connection with a three phase, four wire system in connection with which a four-pole automatic transfer switch is employed. However, as those of ordinary skill in the art will recognize, Applicants' present disclosure has applicability within other types of power control and power providing systems as well. Three poles of the transfer switch panel assembly 20 are used to control power to the three phase conductors of the load. The fourth pole of the transfer switch panel assembly 20 controls connection of the load neutral conductor.

Referring now to FIGS. 1 and 2, in this illustrated arrangement, the transfer switch panel assembly 20 comprises a switch panel 26 for mounting the various transfer switch components. The components can include, a first or lower plurality of stationary contact assemblies 40*a-d*, a second or upper plurality of stationary contact assemblies 50*a-d* (illustrated in FIG. 2), a plurality of movable contact assemblies 60*a-d*, two rotatable contact shafts 88, 94, and a plurality of contact retainer plates 100. As illustrated, the first and second plurality of stationary contact assemblies 40, 50 are mounted along a front surface 30 of the switch panel 26.

Generally, the automatic transfer switch panel assembly 20 is in an operating configuration wherein power from a primary power source can pass through the automatic transfer switch. Accordingly, most "first" positions or normally closed positions discussed and described herein generally correspond to this operating configuration (see, e.g., FIG. 4). Alternatively, when the automatic transfer switch 20 is in a second or an alternative operating configuration wherein power from a secondary power source can pass through the automatic transfer switch, most components of the transfer switch are in "second" positions or emergency closed positions (see, e.g., FIG. 5) as discussed and described herein.

Various aspects of the disclosed transfer switch contact arrangements are described in association with an automatic transfer switch having a single phase. However, as those of ordinary skill will recognize, the disclosed transfer switch contact arrangements may be applicable to a wide range of transfer switches or circuit interrupters having any number of phases or poles, and to stationary contact assemblies for those and other electrical switching apparatus.

Figure 3:
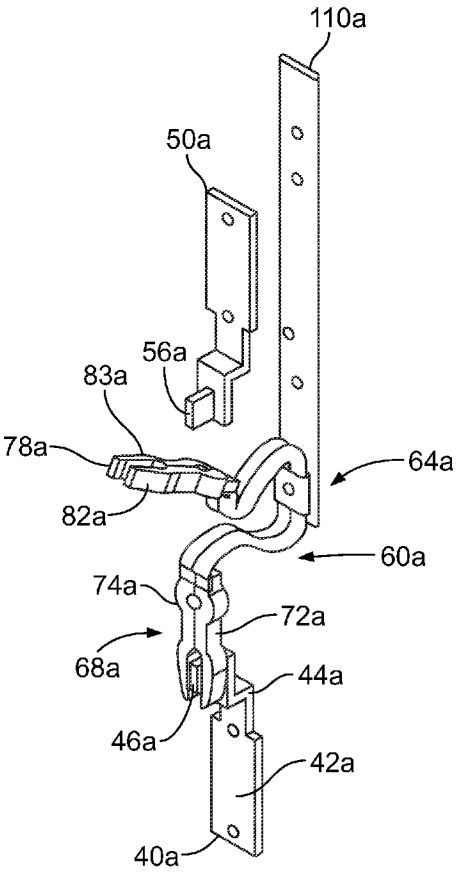
FIG. 3 illustrates a perspective view of one set of contact system components that may be used in the transfer switch panel assembly illustrated in FIGS. 1 and 2 where the movable contact assembly of the contact system components resides in a first or lower position.

FIG. 3 illustrates a perspective view of one set of contact system components that may be used in the transfer switch panel assembly 20 illustrated in FIGS. 1 and 2 where the movable contact assembly 60*a* of the contact system components resides in a first or lower position. As discussed above, in this first or lower position, a first portion 68*a* of the movable contact assembly 60*a* conductively engages a portion of the first stationary contact assembly 40*a*.

Under a first operation where a plurality of moveable contact assemblies 60*a-d* reside in a first or bottom position and as illustrated in FIG. 1, the first rotatable contact shaft 40 may be rotated from a first position to a second position so that a portion of the plurality of moveable contacts 60*a-d* will conductively engage the first plurality of the stationary contacts 40*a-d* located along a bottom portion of the transfer switch panel assembly 20. Similarly, if the first rotatable contact shaft 88 is rotated from this second position back to the first position so that a portion of the plurality of moveable contacts 60*a-d* will conductively engage the second plurality of the stationary contact assemblies 50*a-d* located along an upper portion of the transfer switch panel assembly 20.

Figure 5:
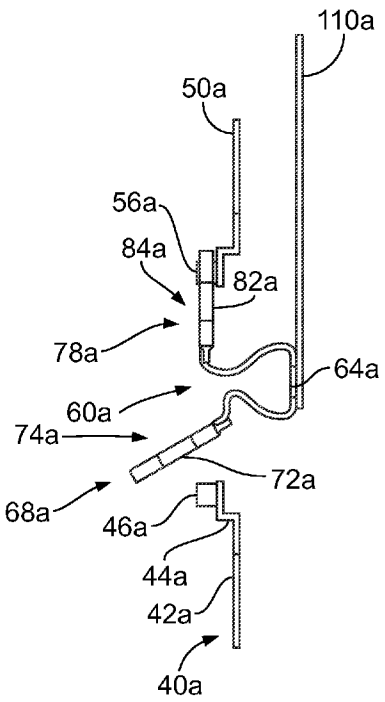
FIG. 5 illustrates a side view of the contact system components illustrated in FIG. 3 wherein the movable contact assembly resides in a second or upper position.
Figure 4:
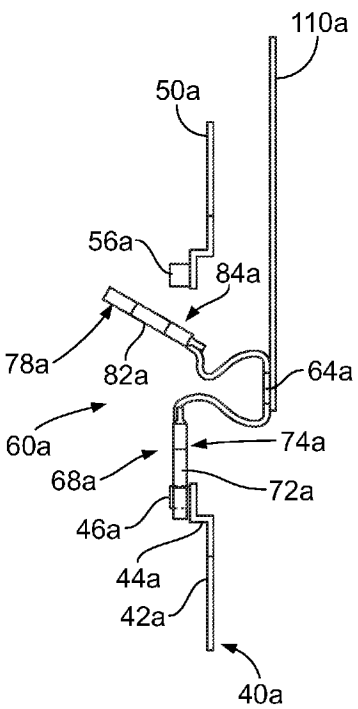
FIG. 4 illustrates a side view of the contact system components illustrated in FIG. 3 wherein the movable contact assembly resides in a first or lower position.

By some external means (such as an automatic transfer mechanism or a manual operator), the contact shafts 88, 94 may be rotated to various positions thereby connecting and/or disconnecting the movable contact assemblies and the stationary contact assemblies. For example, as illustrated in FIG. 4, the contact shafts may be rotated such that a normally closed position is achieved. In addition, and as illustrated in FIG. 5, the contact shafts may be rotated such that an emergency closed position is achieved.

As can be seen from FIGS. 1-5, the first or lower contact stationary contact assemblies 40*a-d* and the upper or second assemblies 50*a-d* may comprise a similar mechanical structure. That is, as illustrated, the first stationary contact assembly 40*a* comprises a main flat body 42*a* generally configured in a rectangular shape. This main flat body 42*a* is mechanically secured to the front surface 30 of the transfer switch panel 26. As also illustrated, the first stationary contact assembly 40*a* further comprises a mechanical step 44*a* that projects away from the main body 42*a* and is vertically offset from the plane of the main flat body 42*a*. Along a flat surface of this mechanical step 44*a*, a stationary contact assembly blade connector 46*a* is provided. As will be described in greater detail below, it is this blade connector 46*a* that becomes operatively and conductively coupled to a portion of a movable contactor assembly 60*a* when the movable contactor assembly 60*a* is pivoted from a second position to a first position. A width of the blade connector 46*a* may be represented by the designation $W_{BC}$ 48 (see, e.g., FIG. 7).

Figure 7:
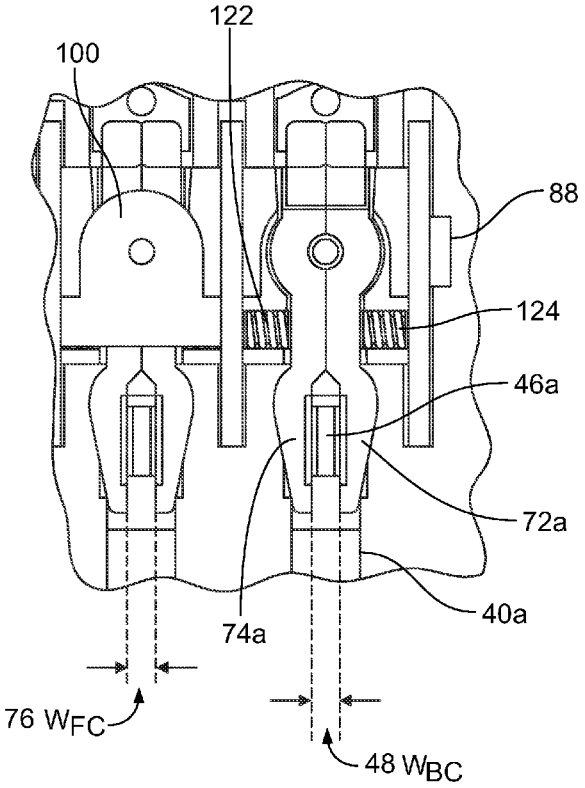
FIG. 7 illustrates a close up view of the contact system illustrated in FIGS. 3 and 4 where the movable contact assembly resides in a first or lower position.
Figure 8:
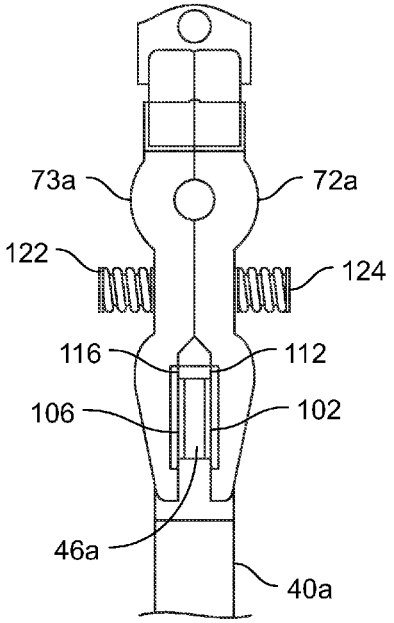
FIG. 8 illustrates another close up view of the contact system illustrated in FIGS. 3 and 4 where the movable contact assembly resides in a first or lower position.

As can also be seen from FIG. 3, the moveable contact assembly 60*a* comprises a first pivoting portion and a second pivoting portion. Preferably, the first pivoting portion comprises a first or lower contact arm 68*a* and the second pivoting portion comprises a second or upper contact arm 78*a*. The first or lower contact arm 68*a* comprises a first and a second longitudinally extending finger conductors 72*a*, 74*a*. Preferably, the first and a second longitudinally extending finger conductors 72*a*, 74*a* face one another and reside parallel to one another. As shown in FIGS. 7 and 8 and discussed in greater detail below, the two movable contact fingers 72*a*, 74*a* are held close together by the spring arrangement 120. Similarly, the second or upper contact arm 78*a* comprises two longitudinally extending finger conductors 82*a*, 83*a* having a similar construction.

Returning to FIGS. 7 and 8, more preferably, a spacing between the two longitudinally extending finger conductors 72*a* and 74*a* may be represented by the distance of the finger width designation $W_{FC}$ 76. This finger conductor width $W_{FC}$ 76 is generally equivalent to the width of the blade connector 46*a* $W_{BC}$ 48 (see, e.g., FIG. 7). As those of skill in the art will recognize, the remaining three movable contact assemblies 60*b-d* of the panel assembly 20 illustrated in FIGS. 1 and 2 can be similarly constructed with first and second contact arms 68*b-d*, 78-*b-d*, respectively.

As can also be seen from FIG. 3, the moveable contact assembly 60*a* further comprises a movable contact assembly center portion 64*a*. It is this movable contact assembly center portion 64*a* that is mechanically attached or linked to a respective conductor 110*a*. When rotated between a first and a second position, the center portion 64*a* allows the movable contact assemblies to pivot about the first arm portion 68*a* and the second arm portion 78*a*. As those of skill in the art will recognize, the remaining three movable contact assemblies 60*b-d* of the panel assembly 20 illustrated in FIGS. 1 and 2 will be similarly constructed to the remaining conductors 110*b-d*, respectively.

As can also be seen from FIG. 3, since this mounting, as the first contact shaft 88 is rotated, the plurality of movable contact assemblies 60*a-d* pivot along their respective center portions 64*a-d* so that either the first or lower arms 68*a-d* of the movable contact assemblies 60*a-d* conductively engage the first or lower stationary contact assemblies 40*a-d*. Alternatively, the movable contact assemblies 60*a-d* may be pivoted so that the second or upper arms 78*a-d* will conductively engage the upper stationary contact assemblies 50*a-d*. As can be seen from FIG. 3, the first or bottom arm 68*a* of the movable contact assembly 60*a* is in conductive engagement with the first or lower stationary contact assembly 40*a*, preferably in conductive engagement with the blade connector 46*a* of the first or lower stationary assembly 40*a*.

In one preferred configuration, the movable contact assemblies 60*a-d* can be simultaneously connected to the first plurality of stationary contact assemblies 40*a-d*, and simultaneously disconnected from second plurality of stationary contact assemblies 50*a-d*.

Other connection and disconnection configurations are also possible. As just one example, the movable contact assemblies 60*a-d* can be connected to the first plurality of stationary contact assemblies 40*a-d* prior to and/or after they are disconnected from second plurality of stationary contact assemblies 50*a-d*. As those of skill in the art will recognize, alternative connection and disconnection configurations may also be utilized.

In addition, as those of skill in the art will recognize, alternative movable and stationary contact assembly arrangements may also be utilized. As just one example, in one alternative arrangement, the movable contact assemblies 60*a-d* may comprise one or more blade connectors and the stationary contact assemblies 40*a-d*, 50*a-d* may comprise one or more longitudinally extending finger conductors. Alternatively, a transfer switch may be provided were certain of the movable contact assemblies 60*a-d* comprising the longitudinally extending finger conductors whereas certain stationary contact assemblies 40*a-d*, 50*a-d* may comprise longitudinally extending finger conductors. Other contact assembly arrangements may also be utilized, and other changes may be made, without departing from the spirit or scope of the subject matter presented herein. It will be readily understood that the aspects of the present disclosure, as generally described herein, and illustrated in the figures, can be arranged, substituted, combined, separated, and designed in a wide variety of different configurations, all of which are explicitly contemplated herein.

The transfer switch panel assembly 20 further comprises a plurality of conductors 110*a-d* and the transfer switch is configured to comprise the same number conductors as moveable contact assemblies 60*a-d*. Basically, and as will be described in greater detail below, each of the plurality of movable contact assemblies 60*a-d* are pivotally bolted or secured to one of the plurality of conductors 110*a-d*. In this manner, the movable contact assemblies 60*a-d* remain in permanent conductive contact with these conductors 110*a-d*. As just one example, and as can be seen from FIG. 3, the moveable contact assembly 60*a* is pivotally bolted or secured to conductor 110*a*.

As illustrated in FIGS. 1 and 2, the plurality of conductors 110*a-d* are positioned along a back surface 32 of the panel assembly 20. These conductors essentially allow power that is provided by the transfer switch panel assembly 20 to be provided to a load that is coupled to the conductors 110*a-d*.

As can be seen from FIG. 2, the transfer switch panel assembly further comprises a contact spring arrangement 120. As will be described in greater detail below, this contact spring arrangement 120 is configured to serve the function of maintaining a proper tension on a contact portion of the moveable contacts 60 *a-d* when these contact portions are in conductive engagement with either the first (i.e., lower) or the second (i.e., upper) plurality of stationary contact assemblies 40, 50, respectively.

FIG. 4 illustrates a side view of the contact system components illustrated in FIG. 3 where the movable contact assembly 60*a* resides in a first or normally closed position. FIG. 5 illustrates a side view of the contact system components illustrated in FIG. 3 where the movable contact assembly 60*a* resides in a second or an emergency closed position. As can be seen from the side view illustrated in FIG. 4, when the moveable contact assembly 60*a* is rotated to the first position (also may be called the normal or lower position), the first moveable contact arm 68*a* will be rotated so that the two longitudinally extending finger conductors 72*a*, 74*a* of the first moveable contact arm 68*a* slides onto or frictionally engages the blade connector 46*a* provided by the first lower stationary contact assembly 50*a* thereby making electrical contact. This configuration allows current to flow from the connector blade 46*a* of the stationary contact assembly 40*a* through the two parallel finger conductors of the 68*a* and then through the conductor 110*a* to the respective load.

Similarly, and as illustrated in FIG. 5, when the movable contact assembly 60*a* is rotated to the second or emergency closed position, the second moveable contact arm 78*a* will be rotated so that the two longitudinally extending finger conductors 82*a*, 84*a* of the second arm 78*a* of the moveable contact assembly 60*a* slides onto or frictionally engages the blade connector 56*a* of the second or upper stationary contact assembly 50*a* thereby making electrical contact. As the moveably contact assembly pivots about its movable contact center portion 64*a*, in this second position and as illustrated in FIG. 5, the first or lower arms of the moveable contact will become disconnected from the lower stationary contact. This configuration allows current to flow from the connector blade 56*a* of the upper stationary contact assembly 50*a* through the two parallel fingers of the 82*a*,84*a* and then through the conductor 110*a* to the respective load.

Figure 6:
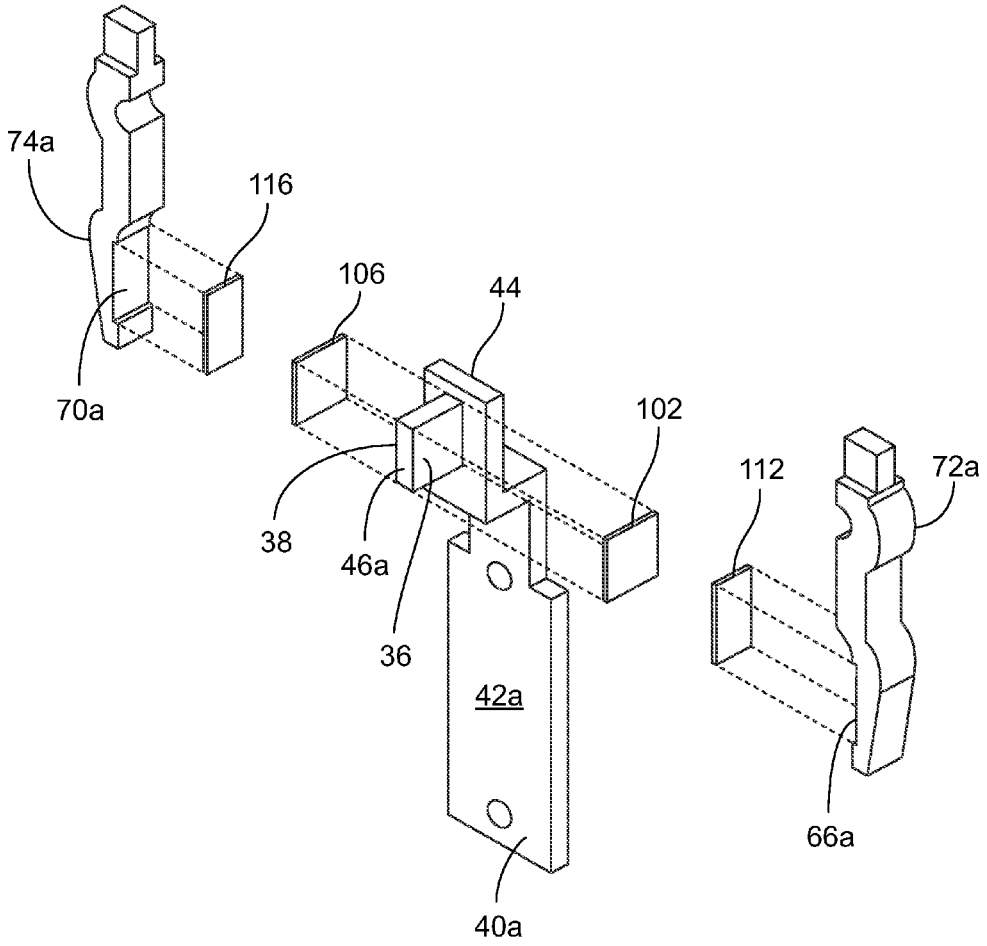
FIG. 6 illustrates a close up view of various contact assembly components of the contact system illustrated in FIGS. 1 and 2.

FIG. 6 illustrates an exploded view of one contact assembly of the contact system illustrated in FIGS. 1 and 2. As illustrated, the contact assembly comprises the stationary contact assembly 40*a*, a first stationary contact tip 102, a second stationary contact tip 106, a first moveable contact tip 112 of the first finger conductor 72*a* of the movable contact assembly 60*a*, and a second moveable contact tip 116 of the second finger conductor 74 of the movable contact assembly 60*a*. In this illustrated arrangement, the first and second stationary contact tips 102, 106 are configured in a generally flat configuration and are provided along a first face 36 and a second face 38 of the blade connector 46*a*, respectively. As just one example, the contact tips 102, 106 may be brazed onto or welded onto the blade connectors using a brazing alloy such as silver alloy. Similarly, the first and second movable contact tips 112, 116 are configured generally flat and are provided along an inner face 66*a* of the first finger conductor 72*a* and along an inner face 70*a* of the second finger conductor 74*a*.

FIG. 7 illustrates a close up view of the contact system illustrated in FIGS. 3 and 4 where the movable contact assembly resides in a first or lower position and further illustrating the contact tip arrangement illustrated in FIG. 6. Similarly, FIG. 8 illustrates another close up view of the contact system illustrated in FIGS. 3 and 4 where the movable contact assembly resides in a first or lower position and also illustrating the contact tip arrangement illustrated in FIG. 6.

As illustrated in FIGS. 7 and 8, the contact spring arrangement 120, is configured so as to urge the first and second arms 72*a*, 74*a* and hence the movable contact tips 112, 116 towards one other thereby providing contact pressure between the contact tips 106 and 102 of the blade connector 56*a* when the blade connector 56*a* resides between the first and second finger conductors 72, 74.

As such, when the connector blade 46*a* first meets the first and second finger conductors 72*a*, 74*a*, the possibility of contact bounce is reduced since the connector blade 46*a* will smoothly enter between the finger conductors as the widths of both are generally equivalent. In one preferred arrangement, this movement may be aided by providing an attenuated edge along an outermost blade connector portion. As the blade connector 46*a* moves in-between the finger conductors 72*a*, 74*a*, there will be reduced frictional drag on the moving finger conductors 72*a*, 74*a* despite the fact the spring arrangement 120 provides a certain amount of contact pressure between the blade connector and the first and second finger conductors.

Figure 9:
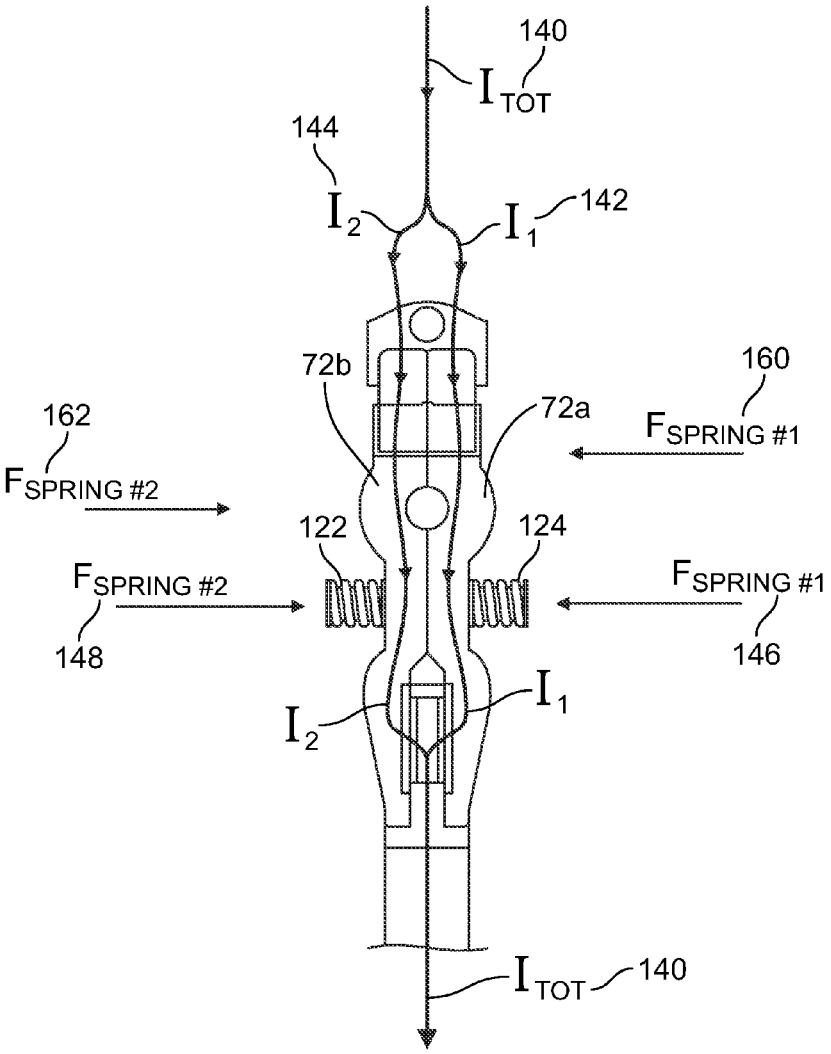
FIG. 9 illustrates another close up view of the contact system illustrated in FIG. 8.

For example, FIG. 9 illustrates a contact arrangement spring force, represented by $F_{spring}$, that is needed for certain rated current of the switch, such as 400 Amps. This spring force $F_{spring}$ comprises the first spring force $F_{spring\ \#1}$ 148 generated by the first spring 122 and the second spring force $F_{spring\ \#2}$ 148 generated by the second spring 124.

The overall contact pressure created by the spring arrangement 120 is increased as a result of the force of attraction between two finger conductors 72*a*, 74*a* as the total current flows in the same direction but is generally divided between both of the parallel finger conductors of the first arm. For example, during a high current fault condition (such as on the order of 10,000 Amps), the total current flowing through the switch contact may be represented by $I_{Total}$ 140. This total current is divided generally equally between a first current $I_1$ 142 flowing through the first finger conductor 72*a* and a second current flowing $I_2$ 144 through the second finger conductor 72*b*. As such, the first current $I_1$ 142 will generate a first magnetic field $F_{Mag\ \#1}$ 160 and the second current $I_2$ 144 will generate a second magnetic field $F_{Mag\ \#2}$ 162. Consequently, this enhanced automatic transfer switch can withstand and/or remain closed during very high short circuit fault currents by employing electromagnetic forces to maintain contact closure.

An additional advantage of this arrangement is that due to the relative size of the movable contact tips 112,116 and stationary contact tips 102, 106, the total contact surface between the finger conductors 72*a*, 74*a* which engage connector blade 46*a* is quite large, thereby considerably increasing the useful life of these contact components. For example, one approximate size of the movable contact tips may be on the order of approximately 0.5×0.5 inches.

For example, as illustrated in FIG. 8, the two springs 122, 124 of spring configuration 120 are oriented opposite of each other and act on the first and second finger conductor 72*a*, 74*a* so as to maintain a constant pressure between a first set of contact tips and a second set of contact tips. In one preferred arrangement, an amount of contact pressure is generated so as to be adequate to achieve a low resistance contact interface capable of carrying typical switching device rated currents, such as on the order of 200 Amps, 400 Amps, or 600 Amps.

For example, the contact pressure needs to be adequate to allow for a low friction sliding motion between contact tips 102, 106 and 112, 116. When the movable contact assemblies and stationary contact assemblies connect, the conductive fingers with attached contact tips are forced spread apart by the stationary contact blade connector with attached contact tips. Low sliding friction results in low insertion force, which in turn, results in faster closing and opening speeds of the complete switch apparatus. For example, when the movable and stationary contacts are opened, there must be sufficient air gap and over surface distance for good dielectric strength.

The contact tips preferably incorporate contact materials to further enhance their short circuit performance and extend endurance life. Preferably, these materials must comprise good anti-arc erosion properties and low sliding friction. In addition, the low electrical resistance and low mechanical friction contact interface between contact tips and is a function of the specific materials used for theses contact tips. As just one example, preferred contact materials of the contact tips could include: copper, copper-chromium-zirconium, silver, silver-nickel, silver-copper, silver-tungsten, silver-tungsten-carbide, silver-tin oxide, silver-cadmium oxide, silver-zinc oxide, and tungsten-copper.

For example, one preferred contact tip alloy comprises of 85% silver, 15% cadmium oxide for the stationary contact tips 102, 106, and a preferred contact tip alloy of 50% silver, 50%$ tungsten carbide for the movable contact tips 112, 116. Alternative contact tip alloy compositions may also be used. As just one example, both the stationary contact tips and the movable contact tips may comprise a similar alloy composition.

During a short circuit fault (i.e., an abnormally high current condition of, for example 10,000 Amps or more) the geometry and location of the movable and stationary contacts creates magnetic forces that cause the movable contacts to clamp onto the stationary contact. As discussed above, this magnetic clamping action prevents contact separation (blowing-off).

While various aspects and embodiments have been disclosed herein, other aspects and embodiments will be apparent to those skilled in the art. The various aspects and embodiments disclosed herein are for purposes of illustration and are not intended to be limiting, with the true scope being indicated by the following claims, along with the full scope of equivalents to which such claims are entitled. It is also to be understood that the terminology used herein is for the purpose of describing particular embodiments only, and is not intended to be limiting.

We claim:

1. A movable contact assembly for use with a switching mechanism, the moveable contact assembly comprising a center portion, a flexible conductor having a first end, a midsection, and a second end, said midsection coupled to said center portion, a first conductor portion extending from said first end of said flexible conductor, said first conductor portion comprising a first arm comprising two longitudinal extending finger conductors;

a second conductor portion extending from said second end of said flexible conductor, said second conductor portion comprising a second arm comprising two longitudinally extending finger conductors;

such that said moveable contact assembly may be pivoted about said center portion from a first position to a second position wherein in said first position, said two longitudinally extending finger conductors of said first conductor portion resides in a conductive state with a blade connector of a first stationary contact assembly of said switching mechanism; and in said second position, said two longitudinally extending finger conductors of said second conductor portion resides in a conductive state with a blade connector of a second stationary contact assembly of said switching mechanism.

2. The invention of claim 1 wherein said first conductor portion comprises a first arm comprising two longitudinal parallel extending finger conductors.

3. The invention of claim 1 wherein said moveable contact assembly may be pivoted about said moveable contact assembly center portion either manually or automatically.

4. The invention of claim 1 wherein at least one of said longitudinally extending finger conductors of said first arm of said movable contact assembly comprises a movable contact tip.

5. The invention of claim 4 wherein said movable contact tip comprises a generally flat movable contact tip, said movable contact tip provided along a first face of said longitudinally extending parallel finger of said first arm.

6. The invention of claim 4 wherein said movable contact tip comprises an alloy composition selected from a group comprising: copper, copper-chromium-zirconium, silver, silver-nickel, silver-copper, silver-tungsten, silver-tungsten-carbide, silver-tin oxide, silver-cadmium oxide, silver-zinc oxide, and tungsten-copper.

7. The invention of claim 6 wherein said movable contact tip of said movable contact assembly comprises a contact tip alloy comprising approximately 85% silver and approximately 15% cadmium oxide.

8. The invention of claim 4 wherein said two parallel finger conductors are spring loaded.

9. The invention of claim 1 further comprising a contact spring arrangement, said contact spring arrangement configured so as to urge said first and said second arm inwardly towards one other thereby providing a contact pressure between a movable contact tip and a connector blade of a stationary contact assembly.

10. The invention of claim 1 wherein said switching mechanism comprises a transfer switch.

11. A movable contact assembly for use with a switching device, the moveable contact assembly comprising a center portion, a flexible conductor having a first end, a midsection, and a second end, said midsection coupled to said center portion, a first conductor portion extending from said first end of said flexible conductor, said first conductor portion comprising a first arm comprising a first blade connector;

a second conductor portion extending from said second end of said flexible conductor, said second conductor portion comprising a second arm comprising a second blade connector;

such that said moveable contact assembly may be pivoted about said center portion from a first position to a second position wherein in said first position, said first connector blade of said first conductor portion resides in a conductive state with two longitudinally extending finger conductors of a first stationary contact assembly; and in said second position, said second connector blade of said second conductor portion resides in a conductive state with two longitudinally extending finger conductors of a second stationary contact assembly.

12. The invention of claim 11 wherein said two longitudinally extending finger conductors of said first stationary contact assembly comprise parallel longitudinally extending finger conductors.

13. The invention of claim 11 wherein said moveable contact assembly may be pivoted about said moveable contact assembly center portion either manually or automatically.

14. The invention of claim 11 wherein said first blade connector of said first conductor portion comprises a movable contact tip.

15. The invention of claim 14 wherein said movable contact tip comprises a generally rectangular movable contact tip, said rectangular movable contact tip provided along a first face of said first blade connector of said first arm.

16. The invention of claim 14 wherein said movable contact tip comprises an alloy composition selected from a group comprising: copper, copper-chromium-zirconium, silver, silver-nickel, silver-copper, silver-tungsten, silver-tungsten-carbide, silver-tin oxide, silver-cadmium oxide, silver-zinc oxide, and tungsten-copper.

17. The invention of claim 11 wherein said transfer device comprises a transfer switch.

18. The invention of claim 17 wherein said transfer switch comprises a four-pole transfer switch.

* * * * *